United States Patent [19]

Gilmore

[11] Patent Number: 4,789,068

[45] Date of Patent: Dec. 6, 1988

[54] WOOD CHIP CLASSIFYING SYSTEM

[76] Inventor: Larry J. Gilmore, 17555 SE. Braden, Gladstone, Oreg. 97027

[21] Appl. No.: 863,053

[22] Filed: May 14, 1986

[51] Int. Cl.[4] ..... B07B 9/02

[52] U.S. Cl. ..... 209/44.3; 209/234; 209/235; 209/250

[58] Field of Search ..... 209/12, 44.3, 234, 255, 209/257, 261, 262, 270, 284, 285, 286, 295, 380, 643, 660, 664, 667, 671, 672, 629, 634, 680, 683, 45, 233, 44.1

[56] References Cited

U.S. PATENT DOCUMENTS

| | | | |
|---|---|---|---|
| 801,141 | 10/1905 | Erickson | 209/295 X |
| 1,685,512 | 9/1928 | Varusky | 209/285 X |
| 2,928,542 | 3/1960 | Mencimer | 209/45 |
| 2,949,187 | 8/1960 | Owens | 209/380 X |
| 3,616,904 | 11/1971 | Aremaa | 209/380 X |
| 4,037,723 | 7/1977 | Wahl et al. | 209/671 X |
| 4,143,665 | 3/1979 | Griffin | 209/45 |
| 4,165,278 | 8/1979 | Jaffey | 209/45 |
| 4,229,286 | 10/1980 | Bridges | 209/285 X |
| 4,376,042 | 3/1983 | Brown | 209/672 |
| 4,387,019 | 6/1983 | Dale et al. | 209/44.3 X |
| 4,430,210 | 2/1984 | Tuuha | 209/672 |
| 4,529,509 | 7/1985 | Nilsson | 209/380 X |
| 4,538,734 | 9/1985 | Gill | 209/672 X |

FOREIGN PATENT DOCUMENTS

| | | | |
|---|---|---|---|
| 1085752 | 7/1960 | Fed. Rep. of Germany | 209/672 |
| 557526 | 2/1957 | Italy | 209/683 |

*Primary Examiner*—Robert B. Reeves
*Assistant Examiner*—Donald T. Hajec
*Attorney, Agent, or Firm*—Robert L. Harrington

[57] ABSTRACT

A multi-stage apparatus and process for separating wood chips of a desired size range for pulp production, from an intermixture of materials e.g. from a log chipper. A disc screen screens out the chips and other materials having a size larger than the designated size range. The chips are deposited on an air separating screen through which a vacuum is drawn to draw out the smaller size materials, e.g. sawdust, and to deposit the desired pulp chips for collection and conveyence to the paper processing station.

7 Claims, 1 Drawing Sheet

WOOD CHIP CLASSIFYING SYSTEM

FIELD OF INVENTION

This invention relates to the separation of wood chips, pins and fibre into size ranges, to be used in paper processing and the like.

BACKGROUND OF INVENTION

Wood chips, pins and fibre produced for example by chipping logs, are largely used in pulp mills for producing paper products. (Material produced from log chipping and the like, although commonly identified by such terms as pins, pin chips, fibre, wood chips etc. will hereafter be encompassed in the collective use of the term "wood chips".) As a first stage in this paper producing process, the wood chips are cooked in a controlled manner to break down the wood fibres. This creates the pulp batter that forms the basic material for the paper.

The cooking stage is very important to the process of making paper products. It is not desirable to either overcook or undercook the chips. It takes longer to cook a large chip then it does a smaller one. Thus an intermixture of large and small chips (including "sawdust" size particles) will result in either an undercooking of the larger chips, or an overcooking of the smaller chips (or more likely a little of both). Thus it is highly desirable to separate the chips by size so that the cooking procedure can be tailored to the specific size of chip and thereby avoid undercooking or overcooking.

BRIEF DESCRIPTION OF INVENTION

The present invention is based on a two-stage screening process, or perhaps more accurately, a pre-selection process followed by specific screening of the preselected materials. In this process, the desired range of chip size is first determined and the first screening stage (or pre-selection process) screens out chips that are larger than the upper end of the size range. It will be appreciated that, as desired, there may be sub-steps in this first screening stage whereby the over sized wood chips are also separated into different size ranges. For the purposes of this invention, the result to be achieved from the pre-selection process is the elimination of those materials that have sizes greater than the selected size range. A second step then screens out chips that are smaller than the lower end of the size range.

The preferred apparatus for accomplishing this two-stage process includes a hopper that is provided with a disc screen. The intermixture of chips is dumped into the hopper and onto the disc screen. The disc screen comprises an array of rotating discs. The discs are spaced apart a distance that permits the chips within the established range and smaller to drop through the screen. The larger chips are rolled off the end of the screen and out of the hopper to be recycled, e.g., to a rechipping station.

The chips that pass through the disc screen are then deposited on top of an air separator comprised of a cylindrical screen that is rotated with it's axis oriented in a horizontal plane. The screen openings are established to prohibit passing of chips larger than the low end of the desired range. A vacuum system associated with the screen, draws the smaller chips (and any other small particles that are present e.g. dust) through the screen. The material passing through the screen is directed to a first station where it is collected and utilized, e.g., for fuel, filler material, or simply discarded as waste. The larger chips are carried by the rotating screen past the affect of the vacuum where the chips are ejected from the screen to be collected and directed to the pulp cooking station.

DETAILED DESCRIPTION AND DRAWINGS

The invention will be more clearly understood and appreciated by reference to the following detailed description, having reference to the following drawings.

Figure 1:
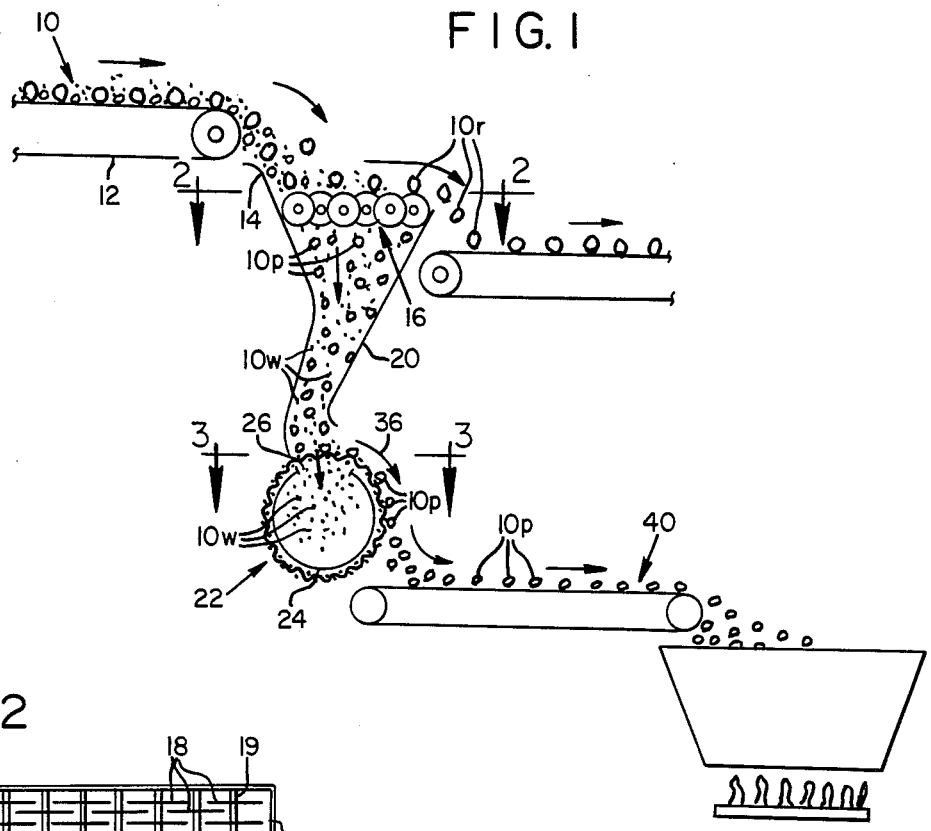
FIG. 1 is a schematic illustration of the process of the invention.
Figure 2:
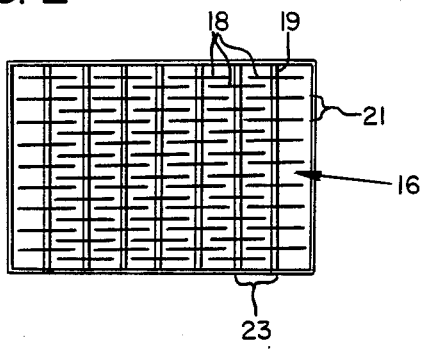
FIG. 2 is a plan view of the disc screen as taken on view lines 2—2 of FIG. 1.

Referring first to the schematic view of FIG. 1, an intermixture of various sized wood chips 10 are carried from a chipping station (not shown), e.g., by a conveyer 12, and dumped into a hopper 14. Contained within the hopper is a disc screen 16. A plan view of the disc screen is shown in FIG. 2 and as noted, this screen is comprised of multiple discs 18 that are journaled on shafts 19 for rotation in a clockwise direction (as shown in FIG. 1). The discs 18 are arranged within the hopper with spacings 21 between them to permit passage down through the screen of wood chips of the selected size and smaller.

The reader should here understand that the intermixture of wood chips 10 are to be divided into at least three size ranges. Chips (and other materials) that are larger than said certain size defined by the disc spacings, will be hereafter referred to as recycling chips **10*r*. Chips that fall in the desired or designated size range for paper production will be referred to as pulping chips 10*p*. Materials smaller than the desired range will be referred to as chip fines 10*w***.

Figure 3:
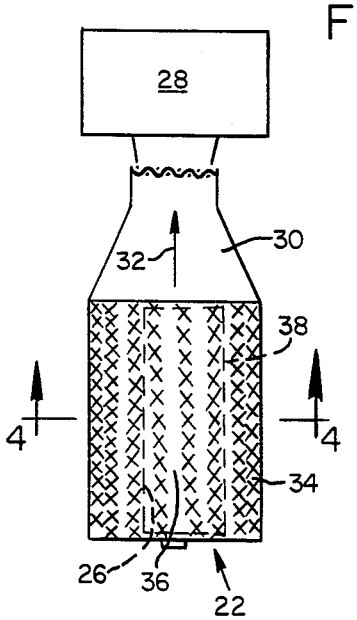
FIG. 3 is a plan view of the drum screen as taken on views lines 3—3 of FIG. 1.
Figure 4:
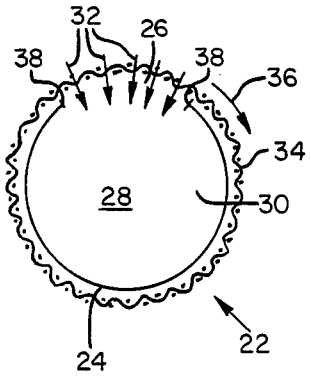
FIG. 4 is a cross sectional view as taken on view lines 4—4 of FIG. 3.

It will be appreciated that the wood chip materials that pass through the disc screen is a mixture of pulping chips **10*p* and chip fines 10*w*. This mixture then flows through the hopper chute 20 and is deposited onto an air separator 22. The air separator 22 includes a stationary inner manifold or shield 24 that is essentially closed except for a slot-like opening or manifold inlet 26 that extends across the top of the manifold. A vacuum source designated as 28 in FIG. 3 is connected to the manifold end through a duct 30. The suction created by the vacuum souce creates air flow into the manifold 24 through the manifold inlet 26 as illustrated by arrows 32 in FIG. 4**.

Surrounding the manifold 24 is a cylindrical screen 34. The screen 34 is designed to rotate around the manifold as indicatd by arrow 36 in FIGS. 1 and 4. It will be appreciated that air indicated by arrows 32 is drawn through the openings in screen 34 but only in the area of the manifold inlet 26 in the manifold 24. It is desirable that air is drawn only through the screen portion that at any given time is positioned over the opening 26 and thus air seals 38 are positioned on the drum around the opening 26. Such seals are common and no effect is here made to provide a specific description thereof. However, it will be appreciated that the air seal is preferably provided across the ends of the slot openings 26 as well as along the side edges. (See FIG. 3 which illustrates the seal in dash outlines).

In operation, the cylindrical screen 34 receives the intermixture of the pulp wood chips 10*p* and wood chip fines 10*w* at a position near the top of the cylinder, i.e., in the vicinity of the manifold opening 26. The screen, which is rotating, directs the mixture from the point of deposit across the top and over the side. During this time, the mixture is exposed to air flow from the manifold opening 26 as indicated by arrows 32. The effect of passing the wood chips over the manifold opening 26 is to draw the materials small enough to pass through the openings of the screen 34 into the manifold 24 and out through the duct 30. This material, as determined by the screen openings, is the chip fines 10*w*. Continued movement of the wood chips rejected by the screen is thereafter cut off from the air flow, and by the effect of gravity is deposited for collection and conveyence, e.g., by a conveyor 40 to a pulp cooker 42. Thus only the designated pulp chips 10*p* are carried by the screen 34 over the side to be deposited onto the conveyor 40 as indicated in FIG. 1.

PRIOR ART DISCUSSION

Two patents are believed pertinent to this invention, i.e., Schoenegg, U.S. Pat. No. 1,640,010 and Jaffey, U.S. Pat. No. 4,165,278. Before discussing the deficiencies of these patents, the benefits of the present invention are hereafter summarized.

This invention deals specifically with the separation of pulping chips of a selected size range from an intermixture of chips of different sizes. The wood chips falling within the selected size range can be cooked in a pulp wood cooker and brought to a ready condition for paper production with acceptable consistency.

The invention first recognizes that the important consideration is to generate a substantially pure pulp chip consistency out of the intermixture. Thus in the first stage of separation, it is not a great concern that some of the sawdust/fines material 10*w* and pulp chips 10*p* are screened and conveyed out of the hopper 14 by the disc screen in this first screening operation. Recall that it is being recycled and will thus be introduced back into the system. What is important is to make sure that none of the larger chips, i.e., wood chips/chunks 10*r* are allowed to pass through. That is accomplished by the mechanical screening process herein designated as the disc screen.

In the next step it is important to remove the very fine materials as it can contaminate the pulp producing process. A simple mechanical screen does not function well to separate out fine materials like sawdust. However, suction is very effective and the invention thus provides substantial exposure of the intermixture 10*p* and 10*w* to the air flow. These materials are relatively light and are effectively drawn toward the opening 26. The rotating screen is sized to prevent passage of the desired chips or fibre 10*p* while the sawdust 10*w* is drawn through the screen and into the vacuum duct 30.

It will thus be appreciated that this invention has solved a serious problem for the paper producing industry by the multistage separation process that is highly effective and yet inexpensive and simple in operation.

Schoenegg teaches a rice separator that attempts to separate an intermixture of rice particles into three components, all with a rotating vacuum drum. There is no way to cleanly separate two size ranges of larger than screen size materials using this drum separation. The present invention incorporates a cooperative two stage separation system wherein the larger than desired materials are positively separated out as a first step, and then the smaller than desired materials are taken out by a vacuum system. The important first stage of the process is omitted from Schoenegg.

Jaffey teaches a process of separating materials by mass distinction rather than size. He uses a vacuum drum to differentiate materials that are light enough to be drawn to the drum, from those that are too heavy to be effected by the vacuum. The present invention uses the vacuum to draw the smaller size material (not mass but size) through the screen. All the materials that reach this stage of separation are drawn to the cylindrical screen. The larger sizes (not heavier) are carried by the screen past the effect of the vacuum and deposited.

SPECIFIC DIMENSIONS

From a research of the needs of a specific paper producer, it was determined that the pulp chip sizes should be no smaller than 15 millimeters and no larger than 38 millimeters. The individual discs 18 were selected to have a diameter of 379 milimeters and a thickness of 4.7 millimeters. The discs were mounted on shafts 19 (see FIG. 2) with 80 millimeter spacings 21, center to center, between the discs. Similar shafts 19 at similar disc spacings were mounted sequentially at spacings 23 whereby one set of discs 18 were aligned between the preceding and succeeding row of discs to thereby close the spacings down to the desired 38 millimeter opening. (Suitable restrictions, not shown, were provided to close the spacings 21 between the discs 18 at either end). Thus chips could pass through the screen only if their thickness dimension did not exceed 38 millimeters. The shafts were rotated at 65 RPMs and it was determined that approximately 80% of the desired size range of chips 10*p* and 10*w*, and 0% of the larger chips were consistently passed through the screen and onto the air screen station.

The manifold 24 was an enclosed chamber having a length of 1066 millimeters and a diameter of 838 millimeters. One of the ends was fitted to a duct 30 which was connected to a vacuum source capable of drawing air at the rate of 18,000 cubic feet per minute. The drum position was fixed and the slot like manifold opening 26 was provided substantially along the full manifold length, with a slot width of 381 millimeters. The position of the manifold opening 26 was near center at the top of the manifold and extended from about −15 degrees to +15 degrees from the 12 o'clock position. The cylindrical screen was provided by a stainless steel perforated screen with openings of 15 millimeters. The screen was driven in a clockwise direction as viewed in FIG. 1 at a speed of 47 RPMs. An air seal was provided around the opening 26 to a heighth of 1 inch so as to develope proper air flow.

Having thus provided the detailed disclosure of the preferred embodiment of the invention, those skilled in the art will conceive of numerous variations and modifications. The inventive concept however, encompasses such variations and modifications as defined by the claims appended hereto.

I claim:

1. Apparatus for separating materials comprising pulp wood chips of a designated range from an intermixture including both larger and smaller sized chips comprising; a first separating screen mechanism for separating out the larger size chips and a second separating screen mechanism for separating out the smaller size chips, said first separating screen mechanism including a receiving member for receiving the intermixed material, a screen in the member having screen openings that permits passage only of material of the designated size range and smaller, discharge means for discharging the material not passing through the screen out of the receiving member to be separated from the material passing through the screen, and deposit means for depositing the material passing through the screen onto said second separating screen mechanism;

said second separating screen mechanism including a vacuum chamber having a slot like opening, a vacuum source interconnected to the vacuum chamber to draw air from the vacuum chamber and thereby generate flow of atmospheric air through the slot like opening, a cylindrical screen mounted for rotation in a circular path encircling the chamber and the slot like opening therein and being rotatable around the chamber, and air sealing means for sealing off the flow of air through the screen except for the portion of the screen passing over the slot like opening, the screen having screen openings in said cylindrical screen of a size that restricts passage of the wood chips within the designated lower size range and permits passage of smaller size materials, said slot like opening confined to an upper region of the circular path of the screen, said deposit means delivering the admixture of materials onto the screen at a position where the screen begins to traverse the slot like opening whereby the smaller materials are drawn through the screen with the air flow and the larger wood chips are carried with the screen over the top, past the slot like opening and thus out of the air flow where gravity causes the wood chips to fall off the screen.

2. Apparatus as defined in claim 1 wherein said slot like opening is centrally positioned at the 12 o'clock position of the rotating cylindrical screen.

3. Apparatus as defined in claim 1 wherein the first separating screen means is a disc screen having rotatable discs spaced in an offsetting array to define openings therebetween according to the designated upper size range of the wood chips, means for commonly rotating the discs for movement of the material not passing through the screen toward one end of the screen, said discharge means serving as rejection means for receiving and discharging the material not passing through the screen from the receiving member.

4. A process for separating materials comprised of wood chips of a designated range from an intermixture of chips of both larger and smaller chips which comprises;

depositing the intermixture of chips into a first screening mechanism, screening out the chips larger than the designated size and directing these larger chips away from the screen for recycling, and collecting the accepted materials of the designated size range and smaller, depositing the accepted material onto an upper region of a cylindrical rotating screen of a second screening mechanism, said rotating screen having screen openings for screening out materials smaller than said designated size range, drawing air through the screen openings in a limited area in the top of the screen and in the area wherein the accepted material is deposited to thereby draw chips through the screen having a size smaller than the designated size, directing the said smaller size material away from the rotating screen for disposal;

said rotating screen carrying the chips larger than said screen openings past the air flow to be delivered from the rotating screen as only chips of the designated size range.

5. A process for separating wood chips as defined in claim 4 wherein the larger chips from the first screening mechanism are recycled to a recycling chipper.

6. A process as defined in claim 4 wherein the chips of the designated size range of the second screening mechanism is directed to a paper processing station.

7. A system for separating out of an admixture of wood chips, the wood chips of a designated size range, comprising;

a first discriminating wood chip station for selectively accumulating only wood chips of the designated size range and smaller, a second discriminating wood chip station for selectively accumulating only wood chips of the designated size range and larger, and conveyance means for conveyance of the selectively accumulated wood chips of the first station to the second station whereby the selectively accumulated wood chips of the second station from the chips of the first station are all of the designated size range, and said second station comprising; a manifold having a manifold slot positioned on the top of the manifold and a vacuum source for drawing air into and through the manifold through the manifold slot, a cylindrical screen mounted for rotation in a circular path past the manifold slot, the slot being restricted to an upper region of the circular path of the screen, said screen having screen openings coincident with the lower end of the designated size range whereby chips deposited on the screen will flow through the screen openings and into and through the manifold slot if smaller than the designated size range and will be carried by the screen past the manifold slot for depositing and accumulation if larger than the screen openings.

* * * * *